US008600285B2

(12) United States Patent
Makinodan et al.

(10) Patent No.: US 8,600,285 B2
(45) Date of Patent: Dec. 3, 2013

(54) IMAGE FORMING APPARATUS

(75) Inventors: Jirou Makinodan, Kashiwa (JP); Hiroshige Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 423 days.

(21) Appl. No.: 12/906,746

(22) Filed: Oct. 18, 2010

(65) Prior Publication Data

US 2011/0091258 A1 Apr. 21, 2011

(30) Foreign Application Priority Data

Oct. 20, 2009 (JP) ..... 2009-241695

(51) Int. Cl.
*G03G 15/00* (2006.01)

(52) U.S. Cl.
USPC ..... 399/406; 399/33; 399/67; 399/68; 399/69; 399/320; 399/322; 399/401

(58) Field of Classification Search
USPC ..... 399/406, 401, 122, 320, 322, 67, 68, 399/69, 33, 400
See application file for complete search history.

(56) References Cited

U.S. PATENT DOCUMENTS

| | | | | |
|---|---|---|---|---|
| 8,045,914 | B2 * | 10/2011 | Kato et al. | 399/405 |
| 8,285,170 | B2 * | 10/2012 | Okuda | 399/92 |
| 2002/0075463 | A1 * | 6/2002 | Hashiguchi | 355/27 |
| 2004/0091281 | A1 * | 5/2004 | Kimizuka | 399/92 |
| 2004/0091295 | A1 * | 5/2004 | Nakamura et al. | 399/327 |
| 2005/0238399 | A1 * | 10/2005 | Moteki | 399/406 |

FOREIGN PATENT DOCUMENTS

JP 10-198080 A 7/1998

* cited by examiner

*Primary Examiner* — Matthew G Marini
*Assistant Examiner* — Allister Primo
(74) *Attorney, Agent, or Firm* — Canon USA Inc. IP Division

(57) ABSTRACT

An image forming apparatus includes an image forming unit configured to form an image on a sheet, a fixing unit configured to fix the image formed by the image forming unit on the sheet, a cooling unit configured to cool the sheet having the image fixed thereon by the fixing unit, a curl amount changing unit configured to change an amount of curl of the sheet by bending the sheet having the image fixed thereon, and a path configured to guide the sheet having the image fixed thereon to the image forming unit, after the sheet is conveyed through the curl amount changing unit and the curl amount changing unit. The curl amount changing unit changes an amount of bending the sheet according to whether the sheet is stopped at the cooling unit or not.

18 Claims, 14 Drawing Sheets

FIG.7A

CASE OF NORMALLY CONVEYED SHEET (SHEET CONVEYED WITHOUT SUSPENSION)

| | | | GRAMMAGE | | | | | | | |
|---|---|---|---|---|---|---|---|---|---|---|
| PAPER TYPE | PAPER FEED DIRECTION | FIRST SIDE IMAGE DENSITY | 52~63 | 64~80 | 81~105 | 106~128 | 129~150 | 151~199 | 200~249 | 250~310 |
| NORMAL SHEET | LANDSCAPE PAPER FEED H WIDTH: 250 mm OR WIDER | 75%~100% | 2 | 0 | 0 | 0 | 0 | 0 | 0 | 0 |
| | | 50%~74% | 4 | 2 | 0 | 0 | 0 | 0 | 0 | 0 |
| | | 25%~49% | 6 | 4 | 0 | 0 | 0 | 0 | 0 | 0 |
| | | 0%~24% | 8 | 5 | 0 | 0 | 0 | 0 | 0 | 0 |
| | PORTRAIT PAPER FEED R WIDTH: LESS THAN 250 mm | 75%~100% | 0 | 0 | 0 | 0 | 0 | 0 | 0 | 0 |
| | | 50%~74% | 2 | 2 | 0 | 0 | 0 | 0 | 0 | 0 |
| | | 25%~49% | 5 | 4 | 0 | 0 | 0 | 0 | 0 | 0 |
| | | 0%~24% | 7 | 5 | 0 | 0 | 0 | 0 | 0 | 0 |
| ONE SIDE-COATED PAPER | LANDSCAPE PAPER FEED H WIDTH: 250 mm OR WIDER | 75%~100% | 2 | 2 | 4 | 4 | 4 | 4 | 4 | 4 |
| | | 50%~74% | 3 | 3 | 4 | 4 | 4 | 4 | 4 | 4 |
| | | 25%~49% | 5 | 4 | 4 | 4 | 4 | 4 | 4 | 4 |
| | | 0%~24% | 6 | 5 | 4 | 4 | 4 | 4 | 4 | 4 |
| | PORTRAIT PAPER FEED R WIDTH: LESS THAN 250 mm | 75%~100% | 2 | 2 | 4 | 4 | 4 | 4 | 4 | 4 |
| | | 50%~74% | 3 | 3 | 4 | 4 | 4 | 4 | 4 | 4 |
| | | 25%~49% | 5 | 4 | 4 | 4 | 4 | 4 | 4 | 4 |
| | | 0%~24% | 6 | 5 | 4 | 4 | 4 | 4 | 4 | 4 |
| TWO SIDE-COATED PAPER | LANDSCAPE PAPER FEED H WIDTH: 250 mm OR WIDER | 75%~100% | 0 | 0 | 0 | 0 | 0 | 0 | 0 | 0 |
| | | 50%~74% | 2 | 2 | 0 | 0 | 0 | 0 | 0 | 0 |
| | | 25%~49% | 4 | 4 | 0 | 0 | 0 | 0 | 0 | 0 |
| | | 0%~24% | 6 | 5 | 0 | 0 | 0 | 0 | 0 | 0 |
| | PORTRAIT PAPER FEED R WIDTH: LESS THAN 250 mm | 75%~100% | 0 | 0 | 0 | 0 | 0 | 0 | 0 | 0 |
| | | 50%~74% | 2 | 2 | 0 | 0 | 0 | 0 | 0 | 0 |
| | | 25%~49% | 5 | 4 | 0 | 0 | 0 | 0 | 0 | 0 |
| | | 0%~24% | 7 | 5 | 0 | 0 | 0 | 0 | 0 | 0 |

FIG.7B

CASE OF SUSPENDED SHEET CONVEYANCE FOR LESS THAN 5 SECONDS

| | | | GRAMMAGE | | | | | | | |
|---|---|---|---|---|---|---|---|---|---|---|
| PAPER TYPE | PAPER FEED DIRECTION | FIRST SIDE IMAGE DENSITY | 52~63 | 64~80 | 81~105 | 106~128 | 129~150 | 151~199 | 200~249 | 250~310 |
| NORMAL SHEET | LANDSCAPE PAPER FEED H WIDTH: 250 mm OR WIDER | 75%~100% | 1 | 0 | 0 | 0 | 0 | 0 | 0 | 0 |
| | | 50%~74% | 3 | 1 | 0 | 0 | 0 | 0 | 0 | 0 |
| | | 25%~49% | 5 | 3 | 0 | 0 | 0 | 0 | 0 | 0 |
| | | 0%~24% | 7 | 4 | 0 | 0 | 0 | 0 | 0 | 0 |
| | PORTRAIT PAPER FEED R WIDTH: LESS THAN 250 mm | 75%~100% | 0 | 0 | 0 | 0 | 0 | 0 | 0 | 0 |
| | | 50%~74% | 1 | 1 | 0 | 0 | 0 | 0 | 0 | 0 |
| | | 25%~49% | 4 | 3 | 0 | 0 | 0 | 0 | 0 | 0 |
| | | 0%~24% | 6 | 4 | 0 | 0 | 0 | 0 | 0 | 0 |
| ONE SIDE-COATED PAPER | LANDSCAPE PAPER FEED H WIDTH: 250 mm OR WIDER | 75%~100% | 1 | 1 | 3 | 3 | 3 | 3 | 3 | 3 |
| | | 50%~74% | 2 | 2 | 3 | 3 | 3 | 3 | 3 | 3 |
| | | 25%~49% | 4 | 3 | 3 | 3 | 3 | 3 | 3 | 3 |
| | | 0%~24% | 5 | 4 | 3 | 3 | 3 | 3 | 3 | 3 |
| | PORTRAIT PAPER FEED R WIDTH: LESS THAN 250 mm | 75%~100% | 1 | 1 | 3 | 3 | 3 | 3 | 3 | 3 |
| | | 50%~74% | 2 | 2 | 3 | 3 | 3 | 3 | 3 | 3 |
| | | 25%~49% | 4 | 3 | 3 | 3 | 3 | 3 | 3 | 3 |
| | | 0%~24% | 5 | 4 | 3 | 3 | 3 | 3 | 3 | 3 |
| TWO SIDE-COATED PAPER | LANDSCAPE PAPER FEED H WIDTH: 250 mm OR WIDER | 75%~100% | 0 | 0 | 0 | 0 | 0 | 0 | 0 | 0 |
| | | 50%~74% | 1 | 1 | 0 | 0 | 0 | 0 | 0 | 0 |
| | | 25%~49% | 3 | 3 | 0 | 0 | 0 | 0 | 0 | 0 |
| | | 0%~24% | 5 | 4 | 0 | 0 | 0 | 0 | 0 | 0 |
| | PORTRAIT PAPER FEED R WIDTH: LESS THAN 250 mm | 75%~100% | 0 | 0 | 0 | 0 | 0 | 0 | 0 | 0 |
| | | 50%~74% | 1 | 1 | 0 | 0 | 0 | 0 | 0 | 0 |
| | | 25%~49% | 4 | 3 | 0 | 0 | 0 | 0 | 0 | 0 |
| | | 0%~24% | 6 | 4 | 0 | 0 | 0 | 0 | 0 | 0 |

FIG.7C

CASE OF SUSPENDED SHEET CONVEYANCE FOR 5 SECONDS OR LONGER

| | | | GRAMMAGE | | | | | | | |
|---|---|---|---|---|---|---|---|---|---|---|
| PAPER TYPE | PAPER FEED DIRECTION | FIRST SIDE IMAGE DENSITY | 52~63 | 64~80 | 81~105 | 106~128 | 129~150 | 151~199 | 200~249 | 250~310 |
| NORMAL SHEET | LANDSCAPE PAPER FEED H WIDTH: 250 mm OR WIDER | 75%~100% | 0 | 0 | 0 | 0 | 0 | 0 | 0 | 0 |
| | | 50%~74% | 2 | 0 | 0 | 0 | 0 | 0 | 0 | 0 |
| | | 25%~49% | 4 | 2 | 0 | 0 | 0 | 0 | 0 | 0 |
| | | 0%~24% | 6 | 3 | 0 | 0 | 0 | 0 | 0 | 0 |
| | PORTRAIT PAPER FEED R WIDTH: LESS THAN 250 mm | 75%~100% | 0 | 0 | 0 | 0 | 0 | 0 | 0 | 0 |
| | | 50%~74% | 0 | 0 | 0 | 0 | 0 | 0 | 0 | 0 |
| | | 25%~49% | 3 | 2 | 0 | 0 | 0 | 0 | 0 | 0 |
| | | 0%~24% | 5 | 3 | 0 | 0 | 0 | 0 | 0 | 0 |
| ONE SIDE-COATED PAPER | LANDSCAPE PAPER FEED H WIDTH: 250 mm OR WIDER | 75%~100% | 0 | 0 | 2 | 2 | 2 | 2 | 2 | 2 |
| | | 50%~74% | 1 | 1 | 2 | 2 | 2 | 2 | 2 | 2 |
| | | 25%~49% | 3 | 2 | 2 | 2 | 2 | 2 | 2 | 2 |
| | | 0%~24% | 4 | 3 | 2 | 2 | 2 | 2 | 2 | 2 |
| | PORTRAIT PAPER FEED R WIDTH: LESS THAN 250 mm | 75%~100% | 0 | 0 | 2 | 2 | 2 | 2 | 2 | 2 |
| | | 50%~74% | 1 | 1 | 2 | 2 | 2 | 2 | 2 | 2 |
| | | 25%~49% | 3 | 2 | 2 | 2 | 2 | 2 | 2 | 2 |
| | | 0%~24% | 4 | 3 | 2 | 2 | 2 | 2 | 2 | 2 |
| TWO SIDE-COATED PAPER | LANDSCAPE PAPER FEED H WIDTH: 250 mm OR WIDER | 75%~100% | 0 | 0 | 0 | 0 | 0 | 0 | 0 | 0 |
| | | 50%~74% | 0 | 0 | 0 | 0 | 0 | 0 | 0 | 0 |
| | | 25%~49% | 2 | 2 | 0 | 0 | 0 | 0 | 0 | 0 |
| | | 0%~24% | 4 | 3 | 0 | 0 | 0 | 0 | 0 | 0 |
| | PORTRAIT PAPER FEED R WIDTH: LESS THAN 250 mm | 75%~100% | 0 | 0 | 0 | 0 | 0 | 0 | 0 | 0 |
| | | 50%~74% | 0 | 0 | 0 | 0 | 0 | 0 | 0 | 0 |
| | | 25%~49% | 3 | 2 | 0 | 0 | 0 | 0 | 0 | 0 |
| | | 0%~24% | 5 | 3 | 0 | 0 | 0 | 0 | 0 | 0 |

FIG.10

| | SHEET CONVEYANCE NOT SUSPENDED | CASE OF SUSPENDED SHEET CONVEYANCE FOR LESS THAN 5 SECONDS | CASE OF SUSPENDED SHEET CONVEYANCE FOR 5 SECONDS OR LONGER |
|---|---|---|---|
| VOLTAGE | 24V | 16.8V | 12V |

IMAGE FORMING APPARATUS

BACKGROUND OF THE INVENTION

1. Field of the Invention

The present invention relates to an image forming apparatus including a fixing unit configured to fix a toner image on a sheet and a cooling unit configured to cool the sheet having the image fixed thereon.

2. Description of the Related Art

A conventional electrophotographic type image forming apparatus, such as a copying machine, a printer, or a facsimile apparatus, transfers a toner image on a sheet, applies heat and pressure on the sheet having the toner image transferred thereon to fix the toner image by using a fixing device, and after that, discharges the sheet having the fixed image to the outside of the apparatus. A sheet may be curled during an operation for fixing a toner image. Degree of a curl of a sheet may differ according to a sheet type, temperature, humidity, and density of an image formed on the sheet.

If a large curl may occur on a sheet during fixing, the sheet may catch in a joint or a hole of a conveyance guide, which may cause a jam. In addition, if a very large curl has occurred on a sheet, a sheet alignment failure may occur during post-processing, such as stapling or folding. In this case, the resulting post-processed product may not have a sufficiently good appearance. In order to solve the above described problem, Japanese Patent Application Laid-Open No. 10-198080 discusses the following method. More specifically, in an image forming apparatus according to this conventional method, a curl amount changing unit, which is provided downstream of a fixing device and configured to change the amount of curl of the sheet, is calibrated according to the type of the sheet and the image density to reduce the amount of the curl.

Conventionally, the orientation and the amount of a curl that may occur at a fixing device according to a predetermined parameter, such as the sheet type or the image density, is changed so that the degree of the sheet curl is reduced by calibrating a curl amount changing unit according to a predicted value or an experimental value obtained by a previously executed experiment. However, the following problems may arise in the conventional method for calibrating a curl amount changing unit.

More specifically, in the conventional method, if image forming is executed at a delayed timing due to delayed image processing on data that has been externally input, the conveyance of a sheet is suspended. In this case, if a sheet having a fixed image is stopped in a conveyance path and if a cooling fan, which is a cooling unit, for fixing a toner image transferred on a sheet exists at a location at which the sheet has been stopped, the degree of the curl may vary. In other words, the degree of a curl may differ according to whether the sheet has been stopped at the cooling unit or not.

To paraphrase this, in the conventional image forming apparatus, a setting value, which is set to the curl amount changing unit, is not set based on a premise that the amount of curl may vary due to suspension of sheet conveyance. Accordingly, if a sheet is stopped at the cooling unit, the curl that has occurred on the sheet may not be set off by the curl amount changing unit to a sufficiently small dimension. Further, in this case, the curl amount changing unit may adversely cause the sheet to curl or increase the curl on the sheet.

If the sheet curl amount cannot be appropriately controlled or changed, a transfer failure may occur when a sheet enters a transfer unit, which transfers a toner image on the sheet, to execute image formation on a second side of the sheet after forming an image on a first side of the sheet. More specifically, if the amount of curl has not been appropriately changed when it is required for the curl amount changing unit to change the curl amount small enough for the sheet to enter the transfer unit in a downward-bent curl state (i.e., in a state where the sheet has a curl having an upward convex shape), the sheet may enter the transfer unit in an upward-bent curl state due to the failure of appropriately changing the curl amount.

SUMMARY OF THE INVENTION

The present invention is directed to an image forming apparatus capable of appropriately changing an amount of a curl on a sheet when the sheet enters a transfer unit to execute image formation on a second side of the sheet.

According to an aspect of the present invention, an image forming apparatus includes an image forming unit configured to form an image on a sheet, a fixing unit configured to fix the image formed by the image forming unit on the sheet, a cooling unit configured to cool the sheet having the image fixed thereon by the fixing unit, a curl amount changing unit configured to change an amount of curl of the sheet by bending the sheet having the image fixed thereon, and a path configured to guide the sheet to the image forming unit, after the sheet is conveyed through the curl amount changing unit and the cooling unit, wherein the curl amount changing unit is configured to change an amount of bending the sheet according to whether the sheet is stopped at the cooling unit or not According to another aspect of the present invention, an image forming apparatus includes an image forming unit configured to form an image on a sheet, a fixing unit configured to fix the image formed by the image forming unit on the sheet, a cooling unit configured to cool the sheet having the image fixed thereon by the fixing unit, and a path configured to guide the sheet having the image fixed thereon to the image forming unit after the sheet is conveyed through the cooling unit, wherein the cooling unit is configured to change a cooling capacity of the cooling unit according to whether the sheet is stopped at the cooling unit or not.

According to an aspect of the present invention, when a sheet enters a transfer unit, a shape of a curl that has occurred on a sheet can be changed to an appropriate shape, even when the sheet, whose first side has been already subjected to image forming, has been stopped at a location in a conveyance path at which a fan is provided.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the present invention.

FIGS. 7A to 7C are matrices illustrating a setting of an amount of engagement of a decurler shaft according to an exemplary embodiment of the present invention.

FIG. 10 is a matrix illustrating a setting of a voltage of a cooling fan according to an exemplary embodiment of the present invention.

DESCRIPTION OF THE EMBODIMENTS

Various exemplary embodiments, features, and aspects of the invention will be described in detail below with reference to the drawings.

Figure 1:
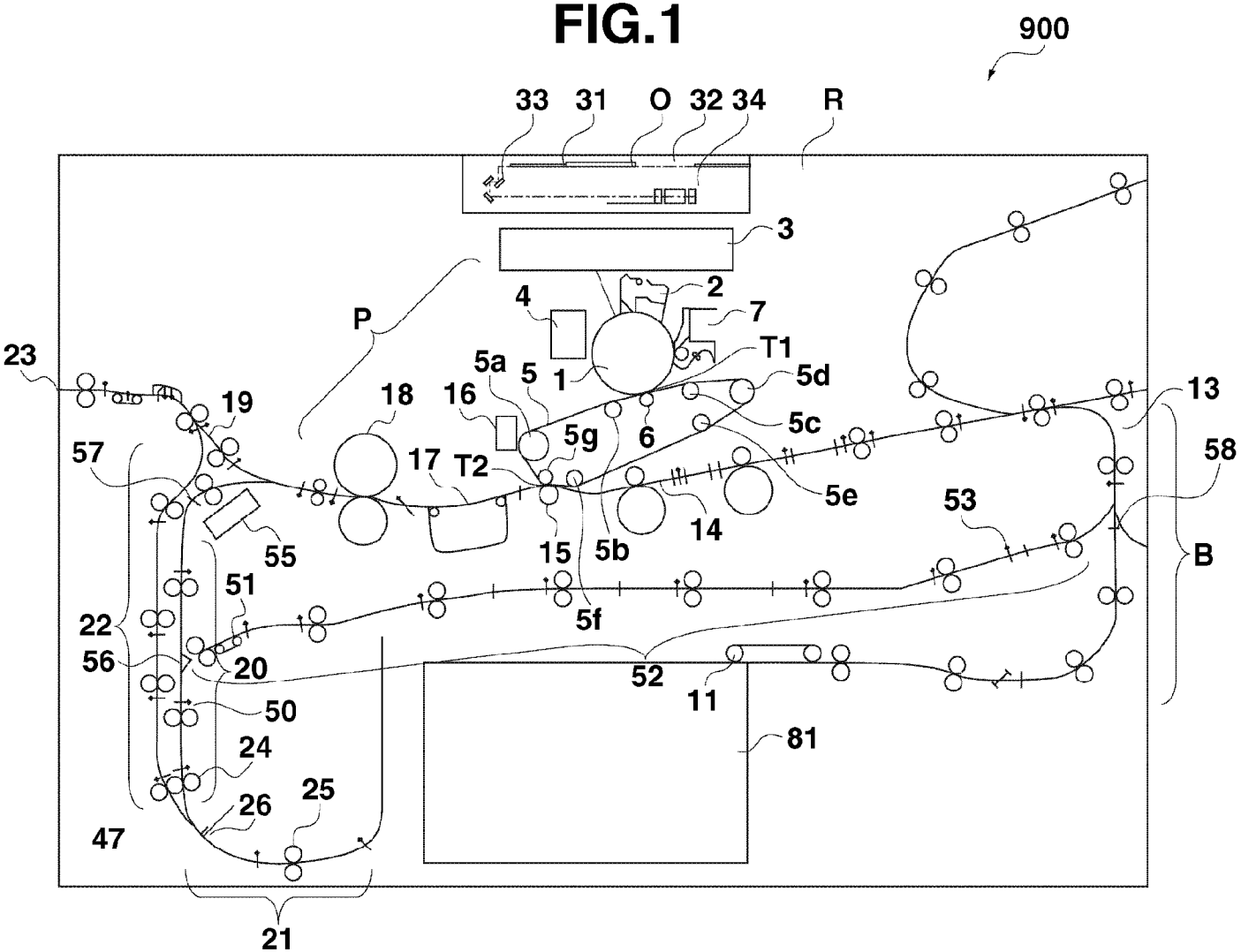
FIG. 1 is across section of an image forming apparatus according to an exemplary embodiment of the present invention.
Figure 2:
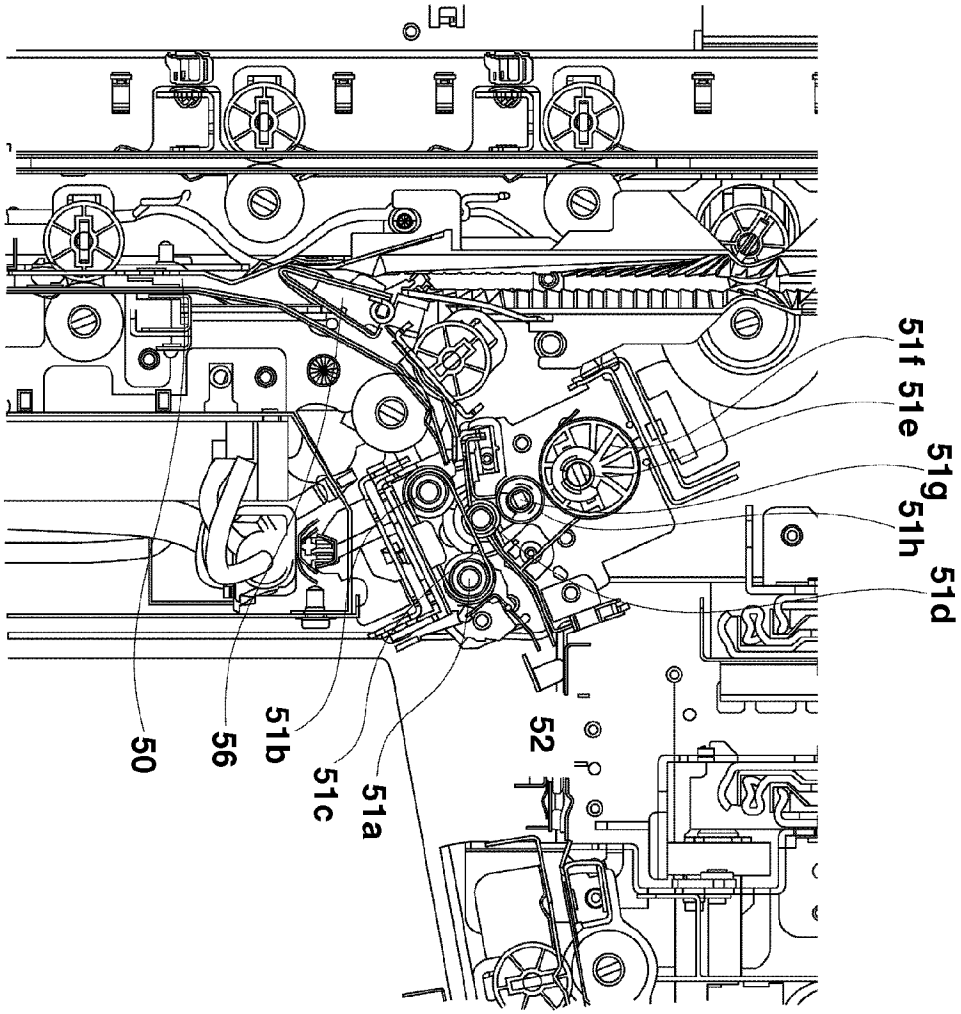
FIG. 2 is a cross section of a decurler and components provided around the decurler according to an exemplary embodiment of the present invention.
Figure 3:
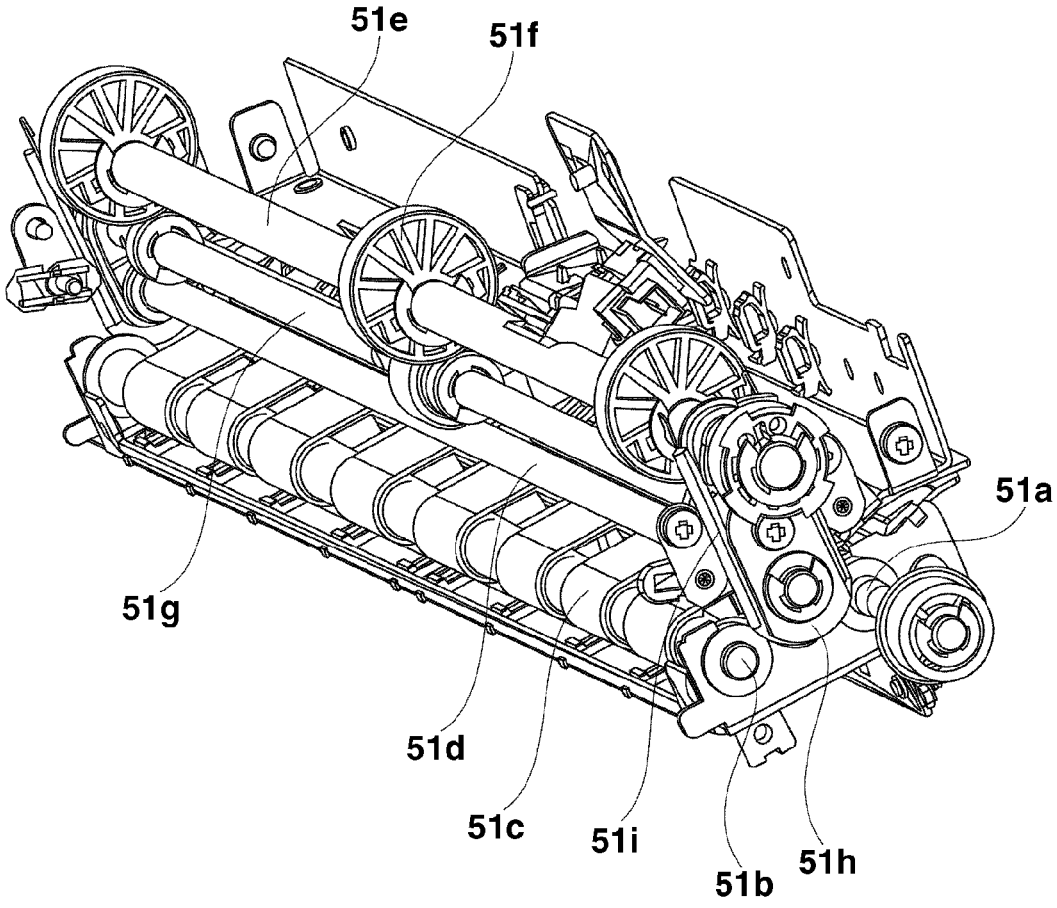
FIG. 3 is a perspective diagram of the decurler according to an exemplary embodiment of the present invention.

FIG. 1 illustrates an exemplary outline configuration of an image forming apparatus 900 according to a first exemplary embodiment of the present invention. FIG. 2 is a cross section of a decurler 51 which is a curl amount changing unit configured to change an amount of a curl of a sheet to an appropriate small amount. FIG. 3 is a perspective view of the decurler 51.

Referring to FIG. 1, a reader unit R reads an image of a document to be copied. The reader unit R includes a document positioning glass 31 and a document pressure plate 32. The document pressure plate 32 can be opened and closed on the document positioning glass 31. In reading an image of a document, a user sets the document on the document positioning glass 31 so that a side of the document having an image faces down on the document positioning glass 31 according to a predetermined document positioning reference mark. When the user closes the document pressure plate 32 in this state, an operation for reading the image of the document starts. However, the present exemplary embodiment is not limited to the above described configuration. More specifically, an auto document feeder (ADF) can be used instead of the document pressure plate 32 so that document sheets can be serially and automatically fed to the document positioning glass 31.

The image reading operation according to the present exemplary embodiment will be described in detail below. A scanner unit 33 moves along a bottom surface of the document positioning glass 31. A lamp (not illustrated) is lit and the scanner unit 33 is moved to irradiate the side of the document having an image with light. Light reflected on the document is input into a charge-coupled device (CCD) 34. The CCD 34 electrically processes the input light into a digital image signal by executing photoelectric conversion. Thus, the image reading operation is completed. The electrically processed image signal is input to a printer unit P which is an image formation unit.

An outline of an operation of the printer P will be described below. The printer unit P primarily includes a photosensitive drum 1, a charging device 2, a laser scanner 3, a development unit 4, an intermediate transfer belt 5, a primary transfer roller 6, a secondary transfer roller 15, and a fixing device 18. The printer unit P forms an image on a sheet.

In the example illustrated in FIG. 1, the photosensitive drum 1 is rotationally driven in the counterclockwise direction. A surface of the photosensitive drum 1 is charged with electricity by the charging device 2, which is a charging unit, to a predetermined polarity and potential. Further, the photosensitive drum 1 is exposed by the laser scanner 3, which is an exposure unit, based on the image signal. In the above described manner, an electrostatic latent image is formed on the surface of the photosensitive drum 1. Alternatively, to an image signal read by the reader unit R, an image signal input by an external apparatus, such as a personal computer (PC) can be used. The electrostatic latent image is developed by the development unit 4 into a toner image.

The intermediate transfer belt 5 (hereinafter simply referred to as the "belt 5") is a flexible endless belt made of a dielectric material. The belt 5 is rotatably stretched around a plurality of rollers 5*a* through 5*g*. An outer circumferential surface of the belt 5 comes in contact with the photosensitive drum 1 between the roller 5*b* and the roller 5*c*. The contact portion constitutes a primary transfer nip T1. At the primary transfer nip T1, the primary transfer roller 6 is provided at a location opposite to the photosensitive drum 1 across the belt 5. The primary transfer roller 6 contacts an inner periphery of the belt 5.

A primary transfer voltage having a polarity reverse to the polarity of the toner is applied to the primary transfer roller 6 at a predetermined control timing. The belt 5 is driven by the roller 5*a* and is rotationally driven in the clockwise direction at a rotational speed approximately as high as a rotational speed of the photosensitive drum 1. A toner image formed on the photosensitive drum 1 is primarily transferred on the belt 5 at the primary transfer nip T1. Residual toner that has not been transferred on the belt 5 and left on the surface of the photosensitive drum 1 is removed by a cleaning device 7.

When a paper feed roller 11 is driven at a predetermined control timing, a sheet stored in a paper feed cassette 81 is fed to a registration roller 14 via a conveyance path 13. The registration roller 14 causes a leading edge of the conveyed sheet to contact a nip to correct skewed conveyance of sheet. Further, the registration roller 14 resumes the conveyance of the sheet stopped to correct the skewed conveyance thereof so that the toner image on the belt 5 is secondarily transferred at an appropriate timing.

The secondary transfer roller 15 is provided at a location opposite to the roller 5*g* across the belt 5. More specifically, a state (position) of the secondary transfer roller 15 can be shifted between a first state in which the belt 5 is pressed by the roller 5*g* against the secondary transfer roller 15, and a second state (not illustrated) in which the secondary transfer roller 15 is separated from the outer periphery of the belt 5. In a default state, the secondary transfer roller 15 is maintained in the second state in which the secondary transfer roller 15 is separated from the outer periphery of the belt 5. If the secondary transfer roller 15 is in the first state, a secondary transfer nip T2 is formed between the outer circumferential surface of the belt 5 and the secondary transfer roller 15. In this state, the image can be secondarily transferred.

The state of the secondary transfer roller 15 is changed to the first state at a predetermined timing. At this timing, the sheet temporarily stopped at the position of the registration roller 14 is conveyed from the registration roller 14 again to the secondary transfer nip T2 so that the leading edge of the sheet comes to the position of the toner image. Then, a secondary transfer voltage is applied to the secondary transfer roller 15. Further, the toner image on the belt 5 is secondarily transferred onto the sheet. Residual toners left on the surface of the belt 5 after the secondary transfer is removed by a cleaning device 16.

After being conveyed through the secondary transfer nip T2, the sheet is further conveyed by a conveyance belt unit 17 to the fixing device 18. The fixing device 18 applies heat and pressure to the toner image to fuse and fix the toner image on the sheet. When the above described operations are completely executed, the image formation on one side of the sheet by the printer unit P ends.

If the sheet is discharged with its side having the fixed image facing up (i.e., when the sheet is discharged by a "face-up discharge method"), the sheet having the image formed and fixed thereon is discharged from a paper discharge unit 23 via a switching flapper (not illustrated) and a conveyance path 19. On the other hand, if the sheet is discharged with its side having the fixed image facing down (i.e., when the sheet is discharged by a "face-down discharge method"), the sheet having the image formed and fixed thereon is discharged into an upstream path 20 via the shift flapper (not illustrated). After the sheet is conveyed through a reversal path 21 by a predetermined conveyance amount, the sheet is then conveyed in a reverse direction. The sheet, whose trailing edge has now come in front of its leading edge in the reversed conveyance direction, is discharged from the paper discharge unit 23 via the shift flapper (not illustrated) and a downstream path 22. After being discharged from the paper discharge unit 23, the sheet is conveyed to a punching unit (not illustrated) and a finisher (not illustrated), which are provided downstream of the image forming apparatus 900, to be subjected to post-processing.

If image forming is executed on both sides of the sheet, the sheet, at first, is conveyed through the fixing device 18. Then, after image formation on one side thereof has been completed, the sheet is conveyed to the upstream path 20. At the same time as the trailing edge of the sheet reaches a reversal point 50, the sheet is conveyed in the reverse direction. After that, a shift flapper 56 which is provided at a branching position between the upstream path 20 and a two-sided path 52 blocks the upstream path 20 to convey the sheet into the two-sided path 52.

In the image forming apparatus according to the first exemplary embodiment, if density of the image formed on the sheet which is applied heat by the fixing device 18 is low, the side of the sheet opposite to the side on which the image is formed (hereinafter simply referred to as an "image side") shrinks. Accordingly, in this case, a curl having a shape convex in the upward direction is likely to occur. In other words, a curl may occur on the sheet in a state where the leading edge and the trailing edge of the sheet, which are edges of the sheet in the direction orthogonal to the sheet conveyance direction, may be oriented downwards at a horizontal position of the sheet after being conveyed through the fixing device 18 (i.e., a curl downward in the sheet conveyance direction may occur). The above described curl may occur due to the following reasons. More specifically, the side of the sheet on which the image is formed hardly shrinks because moisture is not easily lost due to the toner image existing on the sheet while the other side of the sheet, on which no image has been formed, shrinks due to lost moisture.

On the other hand, if the image density is very high, an amount of shrinkage of the toner is greater than the amount of shrinkage of image side of the sheet. Accordingly, a curl may occur so that the leading edge and the trailing edge of the sheet may be oriented upwards (i.e., a curl upward in the sheet conveyance direction may occur).

A cooling unit 57 which is provided in the upstream path 20 includes a cooling fan 55 for cooling the sheet conveyed thereto. The cooling fan 55 is provided to blow air on a side of the sheet on which no image is formed (the other side) after the image formation on one side thereof is completed.

The cooling fan 55 is provided to solve the following problem. Suppose that a thick coated sheet is used as a sheet to be fed to the image forming apparatus. In this case, because the thick coated sheet has a high thermal capacity and is not easy to cool down, it takes a relatively long time until the toner is cooled and fixed on the sheet. Accordingly, if a toner that is still in a soft state and has not been appropriately fixed on the sheet contacts a conveyance roller or a rib of a conveyance path provided in the conveyance path, the image side of the sheet may be scratched by the roller or the rib. In this case, an image failure, such as uneven gloss, may occur. In order to solve the above described problem, the present exemplary embodiment prevents occurrence of the above described uneven gloss on the sheet by blowing air on the sheet using the cooling fan to cool the sheet and fix the toner on the sheet.

As a result of an experiment, the inventor has found that a shape of a curl of a sheet was changed by blowing air on the sheet using the cooling fan 55.

A side of the sheet which is subjected to air blow by the cooling fan 55 is supplied with moisture. Accordingly, in the image forming apparatus according to the first exemplary embodiment, the air is blown by the cooling fan 55 on the side of the sheet having been conveyed through the fixing device 18 that has shrunk due to lost moisture. As a result, the shrunk side of the sheet expands due to the moisture supplied by the air blow. The curl of the sheet is deformed in a direction in which the leading edge and the trailing edge of the sheet go away from the cooling fan 55. Further, the longer the time of air blow by the cooling fan 55 becomes, the greater the deformation of the curl becomes.

An amount of air blow by the cooling fan 55 is determined on the premise that the conveyance of the sheet is not suspended at the cooling unit 57. More specifically, in the first exemplary embodiment, the amount of air blow by the cooling fan 55 is determined so that a curl may not cause any conveyance failure at the secondary transfer nip T2, in parallel with an operation for changing the curl amount performed by the decurler 51, which will be described in detail below. In the present exemplary embodiment, a "curl that may not cause any conveyance failure at the secondary transfer nip T2" refers to a downward curl (i.e., a curl downward in the sheet conveyance direction), in which the leading edge and the trailing edge of the sheet are oriented downwards immediately before a timing at which the sheet enters the secondary transfer nip T2.

In the example illustrated in FIG. 1, the decurler 51 is provided at an entrance of the two-sided path 52. The decurler 51 is a device configured to change an amount of a curl by bending a curled sheet in an orientation opposite to the orientation of the curl. Referring to FIG. 2, a decurler belt 51*c* is stretched around a driving roller 51*a* and a driven roller 51*b*. A decurler shaft 51*d* moves from the outer periphery of the decurler 51 so that the decurler belt 51*c* is bent. Thus, a bend portion is formed. The decurler shaft 51*d* is provided in a direction perpendicular to the sheet conveyance direction.

Both edges of the decurler shaft 51*d* and a pressure shaft 51*g* are supported by a decurler bearing (not illustrated). The decurler bearing is urged by a spring in an upward direction in FIG. 2. The pressure shaft 51*g* is pressed against an eccentric member 51*f*. An eccentric member shaft 51*e* on which the eccentric member 51*f* is mounted is rotated by the decurler driving motor 977, which will be described below with reference to FIG. 3. Thus, the decurler bearing, the pressure shaft 51*g*, and the decurler shaft 51*d* are caused to reciprocate by the eccentric member 51*f*. With the above described configuration, an amount of movement of the decurler shaft 51*d* (i.e., an amount of engagement of the decurler shaft 51*d*) in relation to the decurler belt 51*c* can be adjusted.

The amount of engagement of the decurler shaft 51*d* to the decurler belt 51*c* is equivalent to an amount of bend of the sheet bent by the decurler 51. The amount of bend of the sheet by the decurler 51 can be paraphrased as an amount of curl applied by the decurler 51. In the present exemplary embodiment, the decurler shaft 51*d* moves so that the decurler belt 51*c* is bent. Accordingly, when the sheet is conveyed to the bend portion between the decurler shaft 51*d* and the decurler belt 51*c*, the sheet is bent along a bent shape of the bend portion. In the above described manner, the present exemplary embodiment can change the sheet curl amount. The greater the amount of bend of the decurler belt 51*c* bent by the decurler shaft 51*d* becomes, the greater the amount of the bend of the sheet becomes when the sheet is conveyed through the bend portion. Therefore, the amount of change of the curl becomes large.

In the image forming apparatus according to the first exemplary embodiment, the decurler 51 changes the amount of curl so that the curl of the sheet becomes an upward curl (i.e., a curl upward in the sheet conveyance direction) immediately after the sheet is conveyed through the decurler 51. In other words, the decurler 51 changes the amount of curl so that the leading edge and the trailing edge of the sheet are oriented towards the first side of the sheet on which the image has been formed. By changing the curl in the above described manner, the sheet can enter the secondary transfer nip T2 in a state of the curl in which the leading edge and the trailing edge of the sheet are separated from the belt 5 serving as an image carrier (i.e., in a state in which a downward curl in the sheet conveyance direction has occurred) during image formation on the second side (the other side) of the sheet.

The amount of curl is changed in the above described manner due to the following reason. When the amount of curl of the sheet is changed so that the sheet can enter the secondary transfer nip T2 in the downward-curl state, the downward curl is decurled by the self weight of the sheet. Accordingly, in this case, the sheet can enter the secondary transfer nip T2 in a state where the sheet has almost no curl. Otherwise, even if the curl is not entirely decurled by the self weight of the sheet and a small downward curl is left on the sheet, the sheet can be securely separated from the belt 5 because the curl left on the sheet is oriented opposite to a direction of adherence of the sheet to the belt 5 at the secondary transfer nip T2. As a result, the state of the leading edge of the sheet becomes more stable compared to the case where the sheet enters the secondary transfer nip T2 in the upward-curl state. Accordingly, the present exemplary embodiment can prevent a transfer failure.

The amount of movement of the decurler shaft 51*d* set for changing the curl amount is determined according to predetermined parameters, such as a type of the sheet, and the image density. A precise value of the amount of movement of the decurler shaft 51*d* is determined according to a result of an experiment. FIGS. 7A to 7C illustrate examples of the amount of movement of the decurler shaft 51*d* in relation to the decurler belt 51*c* determined based on a parameter, such as a type and a grammage of the sheet, the image density on the first side of the sheet, and a wait time of the sheet at the cooling unit 57. The amounts of movement of the decurler shaft 51*d* in relation to the decurler belt 51*c* in FIGS. 7A to 7C are a numerical value determined based on experimental results.

After being conveyed through the decurler 51, the sheet is conveyed into the two-sided path 52. The sheet temporarily stops at a two-sided preregistration position 53. After that, the conveyance of the sheet is resumed at a timing appropriately early enough not to contact a subsequent sheet which is conveyed from the paper feed cassette 81 at a predetermined control timing. The two-sided preregistration position 53 refers to a position for adjusting the sheet conveyance timing, in executing image formation on the second side of the sheet, by temporarily stopping the conveyance of the sheet before conveying the sheet to the registration roller 14 which corrects skewed conveyance of the sheet. Then the sheet is conveyed to the registration roller 14, the secondary transfer nip T2, and the fixing device 18 in this order to form an image on the second side of the sheet. Then the sheet having the second-side image is discharged from the paper discharge unit 23 via the conveyance path 19.

Similarly to the processing executed after the image formation on the first side of the sheet, after being discharged from the paper discharge unit 23, the sheet is conveyed to post-processing apparatuses, such as the punching unit (not illustrated) and the finisher (not illustrated) which are provided downstream of the image forming apparatus 900, to be subjected to post-processing.

Figure 4:
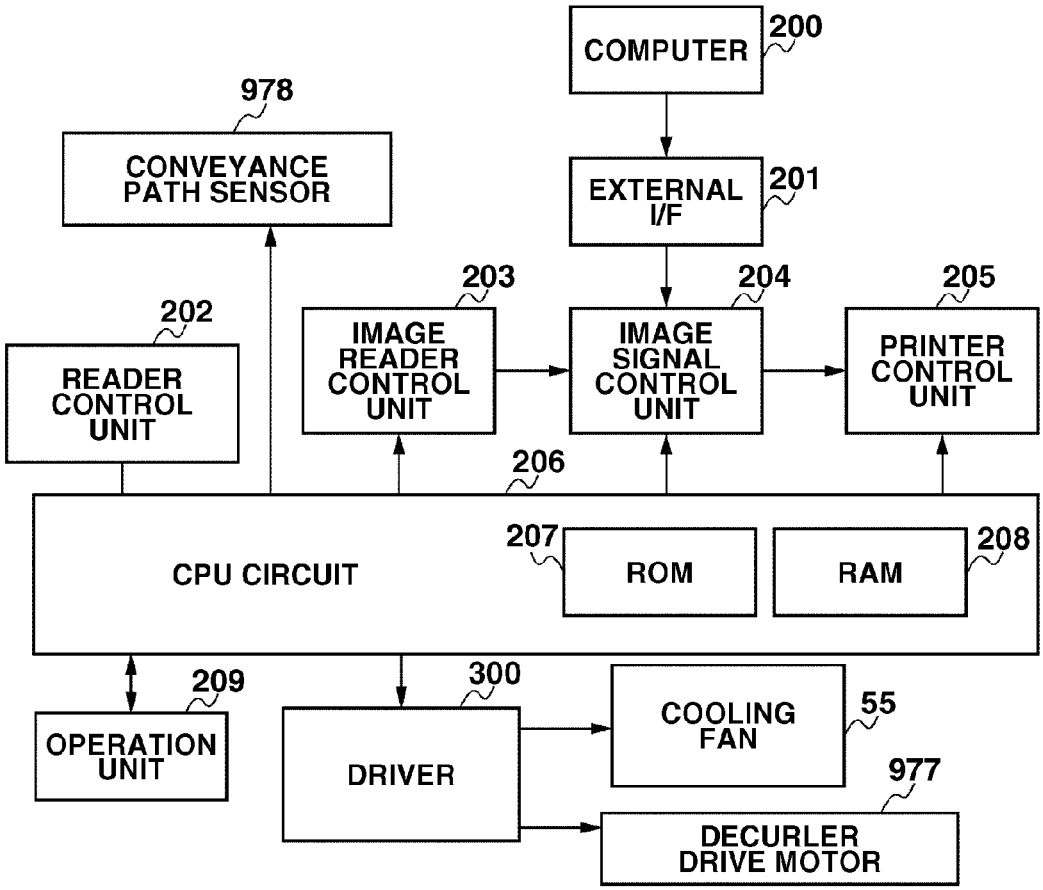
FIG. 4 is a block diagram of a controller according to an exemplary embodiment of the present invention.

FIG. 4 illustrates an example of configuration of a controller which controls the operation of the image forming apparatus 900 in FIG. 1 according to the present exemplary embodiment. Referring to FIG. 4, the controller includes a central processing unit (CPU) circuit 206 which functions as a control unit. The CPU circuit 206 includes a CPU (not illustrated), a read-only memory (ROM) 207, and a random access memory (RAM) 208. The CPU circuit 206 controls a reader control unit 202, an operation unit 209, an image reader control unit 203, an image signal control unit 204, an external interface (I/F) 201, and a printer control unit 205 according to a control program stored on the ROM 207. The RAM 208 temporarily stores control data. In addition, the RAM 28 is used as a work area for calculation executed for the control.

The reader control unit 202 drives and controls the reader unit R according to an instruction from the CPU circuit 206. The image reader control unit 203 drives and controls the scanner unit 33 and an image sensor (not illustrated). Further, the image reader control unit 203 transfers an analog image signal output from the image sensor to the image signal control unit 204.

The image signal control unit 204 converts the analog image signal input by the image sensor into a digital signal and executes various processing on the digital signal. In addition, the image signal control unit 204 converts the digital signal into a video signal and outputs the video signal to the printer control unit 205. Further, the image signal control unit 204 executes various processing on a digital image signal input by an external computer 200 via the external I/F 201. Moreover, the image signal control unit 204 converts the digital image signal into a video signal and outputs the video signal to the printer control unit 205. The image signal control unit 204 executes the above described processing under control of the CPU circuit 206. The printer control unit 205 drives the laser scanner 3 according to the input video signal.

The operation unit 209 includes a plurality of keys for setting various functions necessary for executing image formation and a display unit configured to display information indicating a setting state. In addition, the operation unit 209 outputs a key signal corresponding to a user operation of each key to the CPU circuit 206 and displays a content of the user operation according to the signal input by the CPU circuit 206. The driver 300 is connected to the CPU circuit 206 and drives the cooling fan 55 and the decurler driving motor 977. In addition, a plurality of conveyance path sensors 978 which are sensors for detecting the presence or absence of a sheet in the conveyance path is connected to the CPU circuit 206 so that to the CPU circuit 206 can receive a detection signal from each of the conveyance path sensors 978. The CPU circuit 206 changes the amount of bend of the sheet (i.e., the amount of engagement of the decurler shaft 51*d* in relation to the decurler belt 51*c*) by controlling the operation of the decurler driving motor 977.

Figure 6:
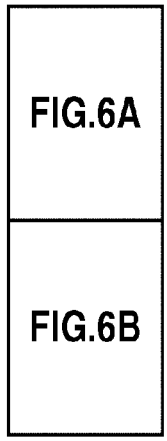
FIGS. 6A and 6B are a flow chart illustrating processing for forming an image on both sides of a plurality of sheets, which is executed by the image forming apparatus according to an exemplary embodiment of the present invention.
Figure 6A:
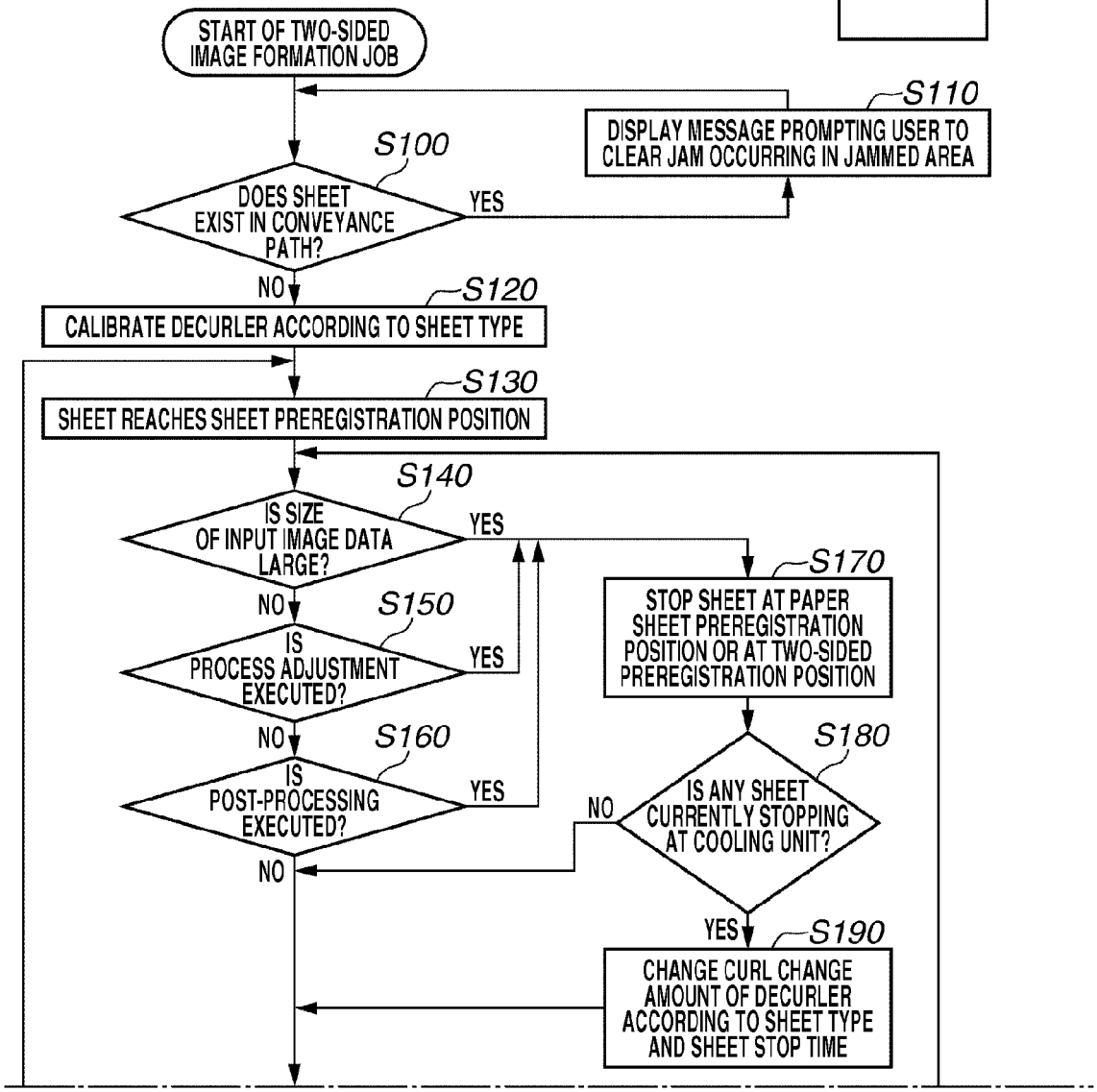
Figure 6B:
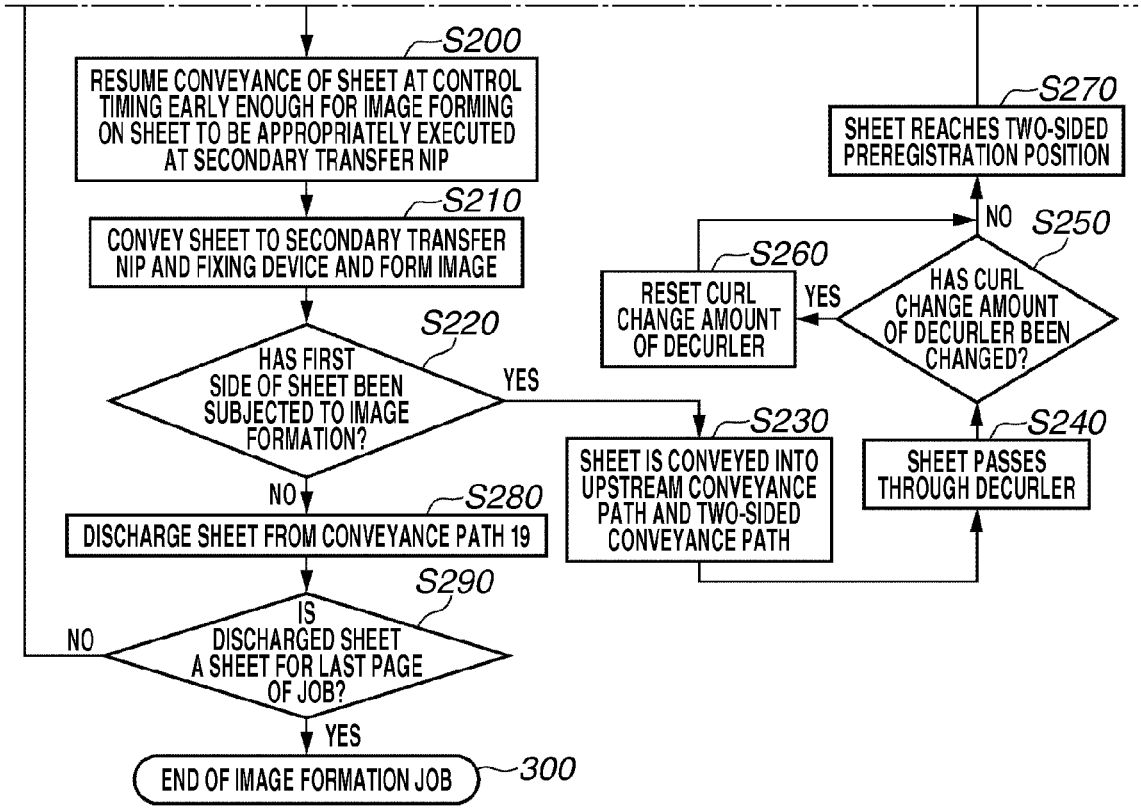

Now, processing will be described below which is executed if the conveyance of the sheet is suspended due to image processing, process adjustment, or the waiting for processing by a post-processing apparatus provided downstream of the image forming apparatus during image formation on the sheet. FIGS. 6A and 6B are a flow chart illustrating an example of processing for forming an image on both sides of each of a plurality of recording materials (sheets) which is executed by the image forming apparatus 900 of the present invention. The operation executed by the image forming apparatus 900 will be described in detail below with reference to the flow chart in FIGS. 6A and 6B. The operation according to the flow chart in FIGS. 6A and 6B is implemented by the CPU circuit 206 by controlling each component of the image forming apparatus 900 according to information input to the CPU circuit 206.

Referring to FIG. 6A, in step S100, when a two-sided image formation job starts, the CPU circuit 206 determines whether a sheet exists in the conveyance path. If it is determined that a sheet exists in the conveyance path (Yes in step S100), then the processing advances to step S110. In step S110, the CPU circuit 206 executes control for displaying a message prompting a user to clear the jam occurring in a jammed area that is where the sheet exists. On the other hand, if it is determined that no sheet exists in the conveyance path, then the processing advances to step S120. In step S120, the CPU circuit 206 adjusts an amount of change of curl executed by the decurler 51 according to the sheet type, the grammage of the sheet, and the image density on the first side of the sheet. As described above, the decurler 51 adjusts the curl change amount by controlling the decurler driving motor 977 which is executed by the CPU circuit 206.

In step S130, the sheet reaches the paper feed preregistration position 58. In step S140, the CPU circuit 206 determines whether a volume of the input image data is large. If it is determined that the volume of the input image data is large (Yes in step S140), then the processing advances to step S170. In step S170, the CPU circuit 206 executes control for temporarily stopping the sheet at the paper feed preregistration position.

During image formation, if large-volume image data is to be image-processed, time for the image processing is required. Accordingly, the processing cannot be completed during a time period from a timing at which the sheet is conveyed through the secondary transfer nip T2 to a timing at which a subsequent sheet is conveyed to the secondary transfer nip T2. Therefore, the CPU circuit 206 temporarily stops the conveyance of the subsequent sheet. During image formation on the first side, the sheet on which an image is formed first when the conveyance is resumed is caused to wait at the paper feed preregistration position 58.

The paper feed preregistration position 58 is a position set to adjust the conveyance timing by temporarily stopping the conveyance before conveying the sheet to the registration roller 14, which corrects skewed sheet, during image formation on the first side. During image formation on the second side, the sheet is caused to temporarily stop and wait at the two-sided preregistration position 53.

On the other hand, if it is determined that the volume of the input image data is not large (No in step S140), then the processing advances to step S150. In step S150, the CPU circuit 206 determines whether to execute process adjustment, such as image density adjustment executed every time a sheet is discharged. If it is determined that process adjustment is not to be executed (No in step S150), then the processing advances to step S160. In step S160, the CPU circuit 206 determines whether to execute post-processing with using the post-processing apparatus provided downstream of the image forming apparatus after the sheet is discharged from the image forming apparatus.

If the results of the determinations in steps S150 and S160 are positive (Yes in steps S150 and S160), then the processing advances to step S170. In step S170, the CPU circuit 206 causes the sheet to stop and wait at the paper feed preregistration position. In this case, during image formation on the second side of the sheet, the CPU circuit 206 causes the sheet to stop and wait at the two-sided preregistration position 53. At this timing, each subsequent sheet is caused to wait at a position at which the subsequent sheet is pinched by the conveyance rollers.

In this case, if any sheet waiting at the cooling unit 57 exists (see FIG. 5, which illustrates an example in which a sheet S is stopping at the cooling unit 57), the sheet is blown by the air from the cooling fan 55. Accordingly, moisture is supplied to the side of the sheet air-blown by the cooling fan 55. As a result, the leading edge and the trailing edge of the sheet are deformed in the orientation away from the cooling fan 55.

Figure 8A:
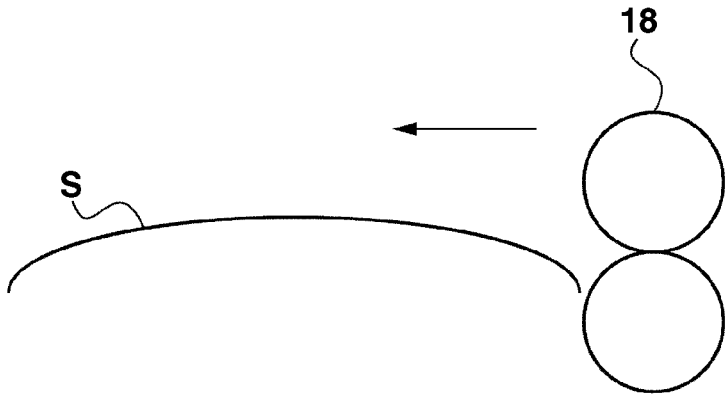
FIGS. 8A and 8B illustrate a state of a curl of a sheet immediately after the sheet is conveyed through a fixing device.
Figure 8B:
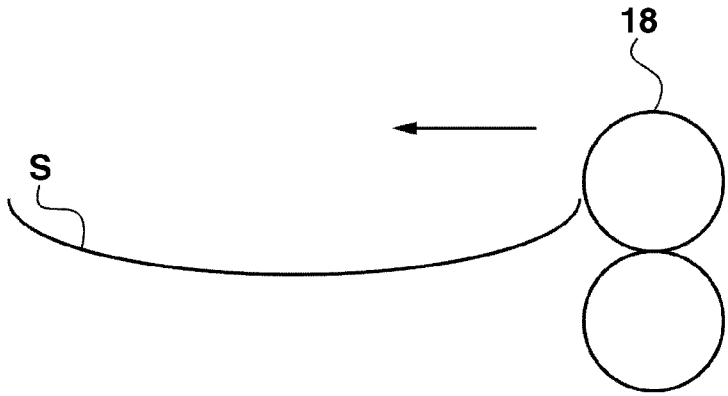

In other words, in the example illustrated in FIG. 8A, compared with the case where the curled sheet is conveyed without being caused to wait, the curl of the sheet in which the leading edge and the trailing edge of the sheet are oriented downwards in relation to the first side having the image formed thereon immediately after being conveyed through the fixing device 18 (i.e., the curl downward in the sheet conveyance direction) is deformed to decrease. On the other hand, in the example illustrated in FIG. 8B, compared with the case where the curled sheet is conveyed without being caused to wait, the curl of the sheet in which the leading edge and the trailing edge of the sheet are oriented upwards in relation to the first side having the image formed thereon after being conveyed through the fixing device 18 (i.e., the curl upward in the sheet conveyance direction) is deformed to increase.

In step S180, the CPU circuit 206 determines whether any sheet currently stopping at the cooling unit 57 exists according to a signal from each conveyance path sensor provided to the cooling unit 57. If it is determined that a sheet currently stopping at the cooling unit 57 exists (Yes in step S180), then the processing advances to step S190. In step S190, the CPU circuit 206 controls the decurler 51 so that the decurler 51 changes the curl change amount (the sheet bending amount) according to the sheet type and sheet conveyance suspension time of the sheet currently stopping at the cooling unit 57.

In order to change the curl amount of the sheet waiting at the cooling unit 57, the CPU circuit 206 sets the amount of engagement of the decurler shaft 51*d* to the decurler belt 51*c* according to the sheet conveyance suspension time and the sheet stop position. If the sheet is stopped at the cooling unit 57, the image forming apparatus according to the present exemplary embodiment sets the curl change amount of the sheet set to the decurler 51 smaller than that set to the decurler 51 if the sheet is not stopped at the cooling unit 57. This is because the leading edge and the trailing edge of the sheet are deformed in the orientation away from the cooling fan 55 due to the air blow by the cooling fan 55 and therefore the shape of the curl has become close to a target curl shape which is intended to be changed by the decurler 51 (i.e., the upward curl).

Accordingly, if the sheet is stopped at the cooling unit 57, the CPU circuit 206 changes the curl change amount changed by the decurler 51 for changing the curl to the upward curl to be smaller than that set when the sheet is not stopped at the cooling unit 57. Therefore, in this case, the curl is changed to the upward curl, which is similar to the curl that may occur when the sheet is not stopped at the cooling unit 57.

As illustrated in FIGS. 7A to 7C, the longer the time of stop of the sheet at the cooling unit 57 becomes, the closer to the shape of the upward curl the shape of the curl of the sheet becomes. Accordingly, the CPU circuit 206 reduces the curl change amount applied by the decurler 51.

If the result of the determination in step S160 or S180 is negative (NO in Step S160, or step S180) or when the processing in step S190 is completed, then the processing advances to step S200. In step S200, the CPU circuit 206 resumes the conveyance of the sheet at a control timing appropriately early enough for the image formation on the sheet to be executed at the secondary transfer nip T2. In step S210, the CPU circuit 206 transfers the toner image on the sheet at the secondary transfer nip T2 and fixes the transferred toner image on the sheet using the fixing device.

In step S220, the CPU circuit 206 determines whether the sheet having the image formed thereon is the first side of the sheet. If it is determined that the sheet having the image formed thereon is the first side of the sheet (Yes in step S220), then the processing advances to step S230. In step S230, the sheet is conveyed to the upstream path 20 and then into the two-sided path 52.

In step S240, the sheet is conveyed through the decurler 51. In step S250, the CPU circuit 206 determines whether the curl change amount set to the decurler 51 has been changed. If it is determined that the curl change amount set to the decurler 51 has been changed (Yes in step S250), then the processing advances to step S260. In step S260, the CPU circuit 206 controls the decurler 51 so that the decurler 51 resets the curl change amount. In step S270, the CPU circuit 206 causes the sheet to pass the two-sided preregistration position. Then, the processing returns to step S140, and the CPU circuit 206 executes the processing in step S140 and beyond.

On the other hand, if it is determined that the sheet having the image formed thereon is not the first side of the sheet (No in step S220), then the processing advances to step S280. In step S280, the sheet is discharged via the conveyance path 19. In step S290, the CPU circuit 206 determines whether the discharged sheet is the sheet for the last page of the job. If it is determined that the discharged sheet is the sheet for the last page of the job (Yes in step S290), then the processing advances to step S300. In step S300, the image formation job ends.

On the other hand, if it is determined that the discharged sheet is not the sheet for the last page of the job (No in step S290), then the processing returns to step S130. In this case, the image forming apparatus 900 executes the processing in step S130 and beyond.

For the wait time at the cooling unit 57, if the conveyance of the sheet is suspended due to image processing, time set according to the volume of the input image data to be image-processed is set as the wait time. On the other hand, if the conveyance of the sheet is suspended due to process adjustment or post-processing, predetermined time set according to the content of the adjustment and the content of the post-processing is set as the wait time.

More specifically, in the first exemplary embodiment, three different wait time values are used. The first wait time value is set in a normal conveyance case in which the conveyance of the sheet is not suspended. The second wait time value is set if the conveyance of the sheet is suspended for less than five seconds. The third wait time value is set if the conveyance of the sheet is suspended for five seconds or longer.

The engagement of the decurler shaft 51*d* to the decurler belt 51*c* is indicated by a numerical value that varies according to the performance (i.e., the productivity or the like) of the image forming apparatus 900. Accordingly, the CPU circuit 206 appropriately changes the amount of engagement of the decurler shaft 51*d* to the decurler belt 51*c* according to the performance of the image forming apparatus 900.

In the above described first exemplary embodiment, the cooling fan 55 blows air on the side of the sheet opposite to the first side on which the image has been formed. In a second exemplary embodiment of the present invention, the cooling fan 55 blows air on the same side of the sheet on which the image has been formed, namely the first side of the sheet. In the second exemplary embodiment, the information processing apparatus has the configuration similar to that of the image forming apparatus according to the first exemplary embodiment except for the location of the cooling fan 55. The method for forming an image according to the second exemplary embodiment is the same as that described above in the first exemplary embodiment.

The processing executed by the image forming apparatus according to the second exemplary embodiment is the same as the processing described above in the first exemplary embodiment with reference to the flow chart in FIGS. 6A and 6B.

However, the second exemplary embodiment is different from the first exemplary embodiment in the following point. More specifically, if the sheet is stopped at the cooling unit 57, the image forming apparatus according to the second exemplary embodiment sets the curl change amount of the sheet (the sheet bending amount) set to the decurler 51 larger than that set to the decurler 51 if the sheet is not stopped at the cooling unit 57, differently from the first exemplary embodiment. Now, the processing executed by the decurler 51 will be described in detail below with reference to the flow chart in FIGS. 6A and 6B.

In step S180, the CPU circuit 206 determines whether any sheet currently stopping at the cooling unit 57 exists according to a signal from each conveyance path sensor (not illustrated) provided to the cooling unit 57. If it is determined that a sheet currently stopping at the cooling unit 57 exists (Yes in step S180), then the processing advances to step S190. In step S190, the CPU circuit 206 adjusts the curl change amount applied by the decurler 51 according to the sheet type and the sheet conveyance suspension time of the sheet currently stopping at the cooling unit 57. As described above, the decurler 51 adjusts the curl change amount by controlling the decurler driving motor 977 which is executed by the CPU circuit 206.

In order to change the curl amount of the sheet waiting at the cooling unit 57, the CPU circuit 206 sets the amount of engagement of the decurler shaft 51*d* to the decurler belt 51*c* according to the sheet conveyance suspension time and the sheet stop position.

If the sheet is stopped at the cooling unit 57, the image forming apparatus according to the present exemplary embodiment sets the curl change amount of the sheet set to the decurler 51 larger than that set to the decurler 51 if the sheet is not stopped at the cooling unit 57. In this case, the leading edge and the trailing edge of the sheet are deformed in the orientation away from the cooling fan 55 due to the air blow by the cooling fan 55. Therefore, the shape of the curl does not become the target curl shape (i.e., the upward curl) which is intended to be changed by the decurler 51 unless the curl change amount set to the decurler 51 is increased.

Accordingly, in the present exemplary embodiment, if the sheet is stopped at the cooling unit 57, the CPU circuit 206 sets the curl change amount that is set to the decurler 51 for changing the shape of the curl to the upward curl and larger than that set to the decurler 51 if the sheet is not stopped at the cooling unit 57. Therefore, the present exemplary embodiment can change the shape of the curl of the sheet to the upward curl which is similar to the shape of the curl that may occur if the sheet is not stopped at the cooling unit 57.

In the present exemplary embodiment, the longer the time of stop of the sheet at the cooling unit 57 becomes, the more the curl becomes deformed in the orientation away from the cooling fan 55. Accordingly, the CPU circuit 206 increases the curl change amount applied by the decurler 51.

Now, a third exemplary embodiment of the present invention will be described in detail below. In the present exemplary embodiment, the curl change amount applied by the decurler 51 is not changed but capacity of the cooling fan 55 for cooling the sheet is changed.

The image forming apparatus 900 according to the third exemplary embodiment has a configuration substantially similar to that of the image forming apparatus 900 according to the first exemplary embodiment described above. Accordingly, the detailed description of the configuration of the present exemplary embodiment similar to that of the first exemplary embodiment will be omitted. The present exemplary embodiment is different from the first exemplary embodiment in terms of the control of the decurler 51 and the cooling fan 55 by the CPU circuit 206.

Figure 5:
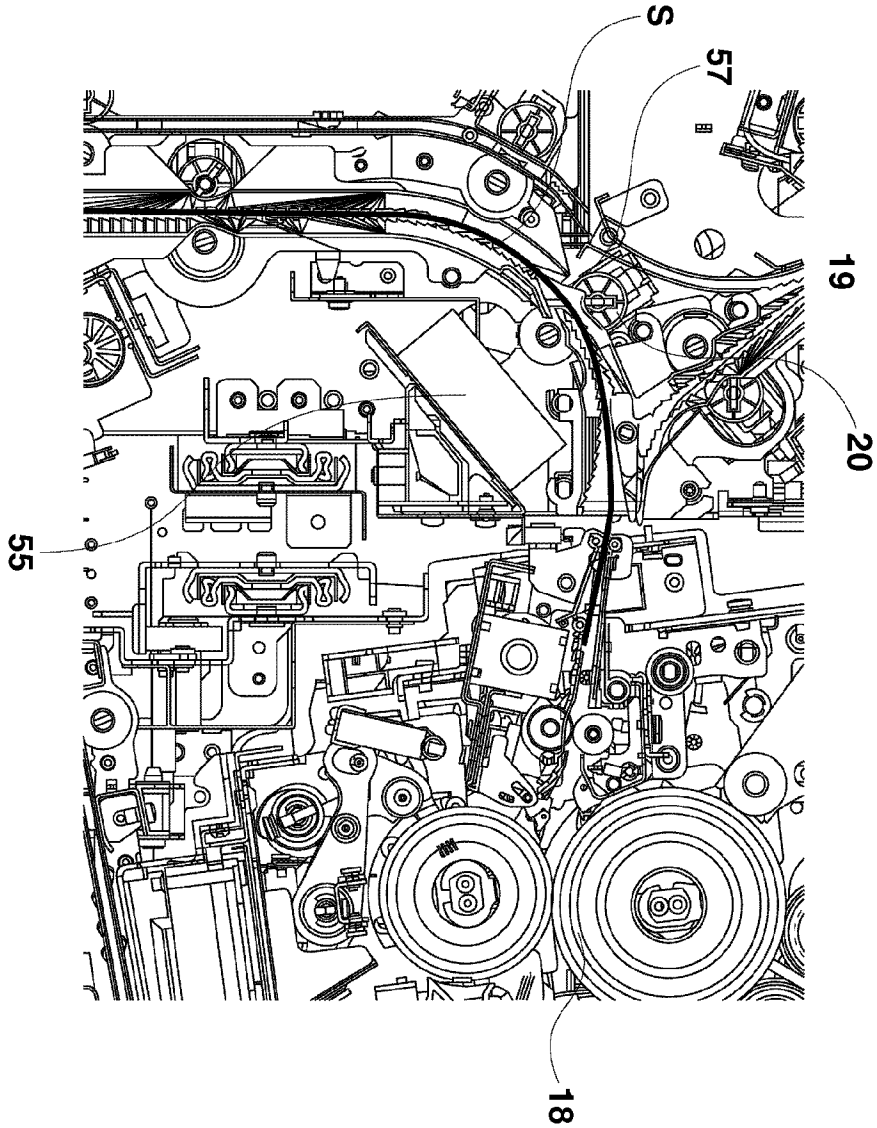
FIG. 5 is a cross section of a cooling unit and components provided around the cooling unit according to an exemplary embodiment of the present invention.

FIG. 5 is a magnified view of the cross section of the cooling unit 57 and the vicinity thereof in the image forming apparatus 900. More specifically, FIG. 5 illustrates a state where the sheet S is stopped at the cooling unit 57. The method for forming an image according to the third exemplary embodiment is similar to that of the first exemplary embodiment.

Now, a method for changing the control of the cooling fan 55 will be described in detail below which is executed if the conveyance of the sheet is suspended due to image processing, process adjustment, or the waiting for processing by a post-processing apparatus provided downstream of the image forming apparatus during image formation on both sides of each of a plurality of sheets.

Figure 9:
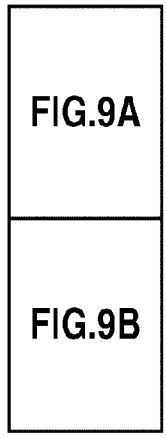
FIGS. 9A and 9B are a flow chart illustrating processing for forming an image on both sides of a plurality of sheets, which is executed by the image forming apparatus according to an exemplary embodiment of the present invention.
Figure 9A:
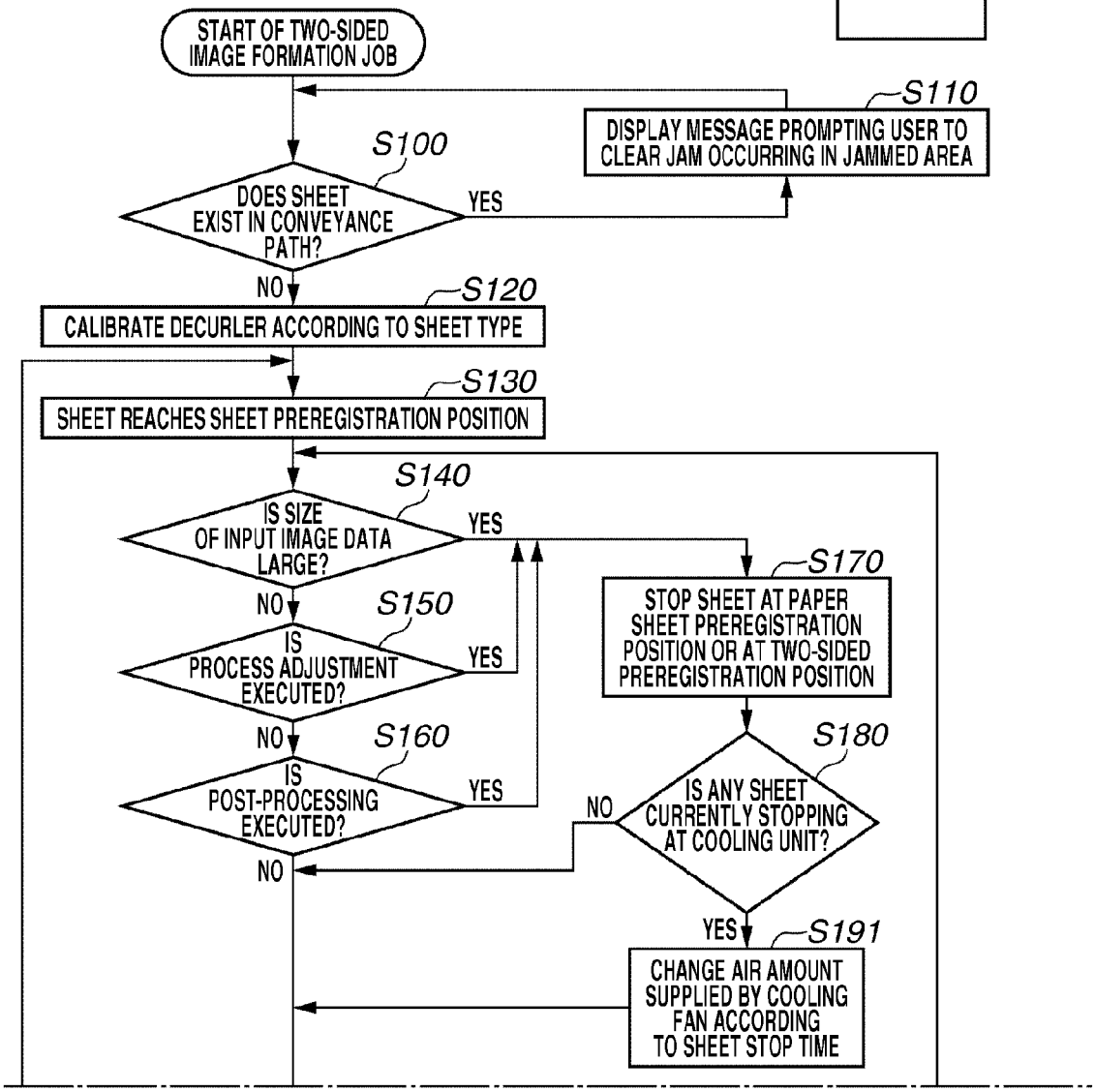
Figure 9B:
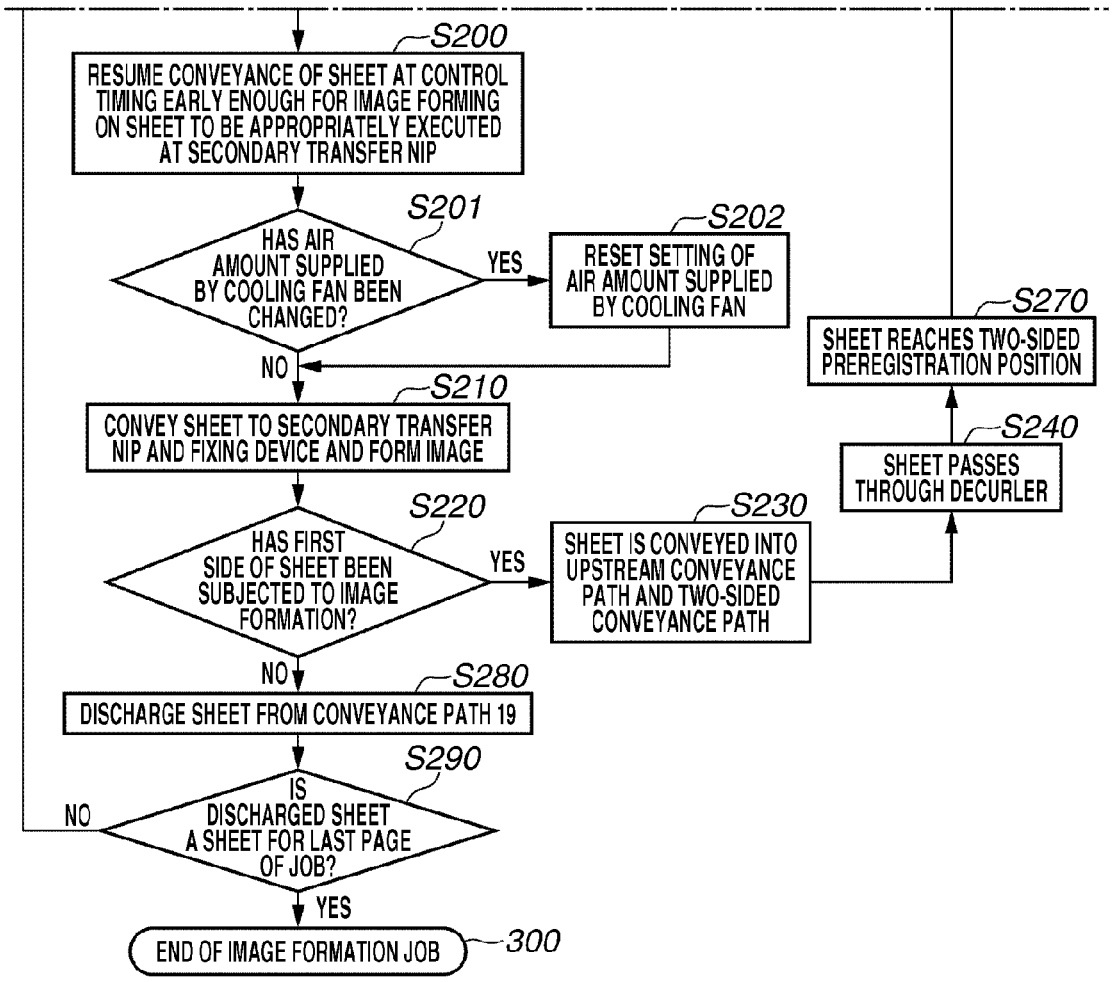

FIGS. 9A and 9B are a flow chart illustrating an example of processing for forming an image on both sides of each of a plurality of sheets which is executed by the image forming apparatus 900 according to the present exemplary embodiment. Processing according to the flow chart in FIGS. 9A and 9B similar to that illustrated in FIGS. 6A and 6B is provided with the same step number. Accordingly, the detailed description thereof will not be repeated here. The third exemplary embodiment is similar to the first exemplary embodiment described above except for the processing executed if any sheet stopping at the cooling unit 57 exists.

During the processing by the image forming apparatus 900, in step S180, the CPU circuit 206 determines whether any sheet currently stopping at the cooling unit 57 exists. If it is determined that a sheet currently stopping at the cooling unit 57 exists (Yes in step S180), then the processing advances to step S191. In step S191, the CPU circuit 206 controls the operation of the cooling fan 55 so that the cooling fan 55 changes the amount of air blown on the sheet according to the sheet conveyance suspension time of the sheet currently stopping at the cooling unit 57.

FIG. 10 illustrates an example of a setting of the amount of air blow set to the cooling fan 55 according to waiting time of the sheet at the cooling unit 57. The amount of air blown by the cooling fan 55 is set and controlled according to the level of the voltage applied to the cooling fan 55. To paraphrase this, if the voltage to be applied to the cooling fan 55 is reduced, the amount of air blown by the cooling fan 55 is reduced. In this case, the cooling capacity of the cooling fan 55 is lowered.

In the image forming apparatus according to the second exemplary embodiment, if the amount of air blown by the cooling fan 55 is normal, the sheet stopping at the cooling unit 57 is deformed in the orientation in which the leading edge and the trailing edge of the sheet goes away from the cooling fan 55. Accordingly, in the third exemplary embodiment, the amount of air blown by the cooling fan 55 is controlled to become smaller (or so that the amount of the blow air becomes zero where necessary) as the sheet conveyance suspension time becomes longer. More specifically, if the conveyance of the sheet is not suspended, the voltage of 24 V is applied, thus the amount of air blown by the cooling fan 55 is large. If the conveyance of the sheet is suspended for less than five seconds, the voltage of 16.8 V is applied, and the amount of air blown by the cooling fan 55 is middle. If the conveyance of the sheet is suspended for five seconds or longer, the voltage of 12 V is applied, and the amount of air blown by the cooling fan 55 is small. In the present exemplary embodiment, the state in which the cooling capacity of the cooling fan 55 is lowered includes a state in which the cooling fan 55 is powered off.

If the sheet is caused to wait at the cooling unit 57, the present exemplary embodiment adjusts the amount of air blown by the cooling fan 55 according to the time required until the conveyance of the sheet is resumed. Thus, the CPU circuit 206 sets the same amount of air supplied to the sheet as the amount of the air supplied to the sheet in the normal conveyance state. With the above described configuration, the amount of curl occurring on the sheet can be controlled to the same amount as the amount of the curl occurring in the normal conveyance state. As a result, it becomes unnecessary to change the curl change amount set to the decurler 51 from that set in the normal conveyance state.

In step S191, the CPU circuit 206 changes the amount of air blown by the cooling fan 55 according to the sheet conveyance suspension time. In step S200, the CPU circuit 206 resumes the conveyance of the sheet at the control timing appropriately early enough for the image formation on the sheet to be executed at the secondary transfer nip T2.

In step S201, the CPU circuit 206 determines whether the amount of air blow by the cooling fan 55 has been changed. If it is determined that the amount of air blow by the cooling fan 55 has not been changed (No in step S201), then the processing advances to step S210, and the CPU circuit 206 executes the processing in step S210 and beyond. On the other hand, if it is determined that the amount of air blow by the cooling fan 55 has been changed (Yes in step S201), then the processing advances to step S202. In step S202, the CPU circuit 206 resets the setting of the amount of air blown by the cooling fan 55. Then the processing advances to step S210, and the CPU circuit 206 executes the processing in step S210 and beyond.

As described above, in the third exemplary embodiment, the cooling fan 55 blows air on the side of the sheet opposite to the first side of the sheet on which the image has been formed. If the cooling fan 55 blows air on the same side (the first side) of the sheet on which the image has been formed, the air is blown on the side of the sheet opposite to the above described case. In this case, the orientation of deformation of the sheet is reversed. If this configuration is employed, the amount of air blown on the sheet is set to the same amount as that in the normal sheet conveyance state by adjusting the amount of air blown by the cooling fan 55 according to the time required for the conveyance of the sheet to be resumed. Accordingly, the amount of the curl that may occur on the sheet can be adjusted to the same amount as the curl occurring in the normal sheet conveyance state. As a result, it becomes unnecessary to change the curl change amount set to the decurler 51 from that set in the normal sheet conveyance state.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-241695 filed Oct. 20, 2009, which is hereby incorporated by reference herein in its entirety.

What is claimed is:

1. An image forming apparatus comprising: an image forming unit configured to form an image on a sheet;

a fixing unit configured to fix the image formed by the image forming unit on the sheet;

a cooling unit configured to cool the sheet having the image fixed thereon by the fixing unit;

a sheet bending unit configured to bend the sheet having the image fixed thereon for changing an amount of curl of the sheet;

a sheet detecting portion configured to detect whether or not a sheet is stopped at the cooling unit; and a controlling unit configured to control the sheet bending unit so that the sheet bending unit changes an amount by which the sheet bending unit bends the sheet according to a detection result of the sheet detection portion which detects whether the sheet is stopped at the cooling unit or not.

2. The image forming apparatus according to claim 1, wherein the cooling unit is configured to cool the side of the sheet opposite to the side of the sheet having the image fixed thereon, wherein the sheet bending unit is configured to bend the sheet so that the curl becomes a curl in which an edge of the sheet in a direction of conveyance of the sheet is oriented towards the side of the sheet having the image fixed thereon, and wherein the controlling unit controls the sheet bending unit so that an amount by which the sheet bending unit bends the sheet stopped at the cooling unit is smaller than an amount by which the sheet bending unit bends the sheet that is not stopped at the cooling unit.

3. The image forming apparatus according to claim 2, wherein if the sheet is stopped at the cooling unit, the controlling unit controls the sheet bending unit so that the amount by which the sheet bending unit bends the sheet is smaller as time of stop of the conveyance of the sheet becomes longer.

4. The image forming apparatus according to claim 1, wherein the cooling unit is configured to cool the one side of the sheet having the image fixed thereon, wherein the sheet bending unit is configured to bend the sheet so that the curl becomes a curl in which an edge of the sheet in a direction of conveyance of the sheet is oriented towards the side of the sheet having the image fixed thereon, and wherein the controlling unit controls the sheet bending unit so that an amount by which the sheet bending unit bends the sheet stopped at the cooling unit is larger than an amount by which the sheet bending unit bends the sheet that is not stopped at the cooling unit.

5. The image forming apparatus according to claim 4, wherein if the sheet is stopped at the cooling unit, the controlling unit controls the sheet bending unit so that the amount by which the sheet bending unit bends the sheet is larger as time of stop of the conveyance of the sheet becomes longer.

6. An image forming apparatus comprising:

an image forming unit configured to form an image on a sheet;

a fixing unit configured to fix the image formed by the image forming unit on the sheet;

a cooling unit configured to cool the sheet having the image fixed thereon by the fixing unit;

a sheet detecting portion configured to detect whether or not a sheet is stopped at the cooling unit; and a controlling unit configured to control the cooling unit so that the cooling unit changes a cooling capacity of the cooling unit according to a detection result of the sheet detection portion which detects whether the sheet is stopped at the cooling unit or not.

7. The image forming apparatus according to claim 6, wherein the cooling unit is configured, if the sheet is stopped at the cooling unit, to adjust the cooling capacity to a level lower than the cooling capacity set if the sheet is not stopped at the cooling unit.

8. The image forming apparatus according to claim 7, wherein the controlling unit controls the cooling unit so that if the sheet is stopped at a stop position, to adjust the cooling capacity of the cooling unit to be smaller as time of stop of the sheet becomes longer.

9. The image forming apparatus according to claim 7, further comprising a sheet bending unit configured to bend the sheet conveyed through the cooling unit for changing an amount of curl of the sheet, wherein the controlling unit controls so that the cooling unit changes the cooling capacity of the cooling unit and the sheet bending unit does not change an amount of bending the sheet according to whether the sheet is stopped at the cooling unit or not.

10. The image forming apparatus according to claim 1, further comprising:

a path configured to guide the sheet having the image fixed thereon to the image forming unit, after the sheet is conveyed through the cooling unit and the sheet bending unit.

11. The image forming apparatus according to claim 9, further comprising:

a path configured to guide the sheet having the image fixed thereon to the image forming unit, after the sheet is conveyed through the cooling unit and the sheet bending unit.

12. The image forming apparatus according to claim 1, wherein the sheet bending unit includes a belt, a shaft which nips the sheet with the belt, and an adjusting mechanism configured to adjust an amount of engagement of the shaft and belt for changing an amount by which the sheet bending unit bends the sheet.

13. The image forming apparatus according to claim 6, wherein the cooling unit includes a fan, and the cooling capacity of the cooling unit is an amount of air blown by the fan.

14. An image forming apparatus comprising:

an image forming unit configured to form an image on a sheet;

a fixing unit configured to fix the image formed by the image forming unit on the sheet;

a cooling unit configured to cool the sheet having the image fixed thereon by the fixing unit;

a first rotary member;

a second rotary member which nips the sheet having the image fixed thereon with the first rotary member, wherein the sheet is nipped by the first rotary member and the second rotary member thereby an amount of curl of the sheet is changed:

an adjusting mechanism configured to adjust an amount of engagement of the first rotary member and the second rotary member;

a sheet detecting portion configured to detect whether or not a sheet is stopped at the cooling unit; and a controlling unit configured to control the adjusting mechanism so that the sheet adjusting mechanism changes an amount of engagement of the first rotary member and the second rotary member according to a detection result of the sheet detection portion which detects whether the sheet is stopped at the cooling unit or not.

15. The image forming apparatus according to claim 14, wherein the first rotary member is a belt and the second rotary member is a shaft, wherein the cooling unit is configured to cool a side of the sheet opposite to a side of the sheet having the image fixed thereon, wherein the shaft contacts the side of the sheet having the image fixed thereon and the belt contacts the side of the sheet opposite to the side of the sheet having the image fixed thereon, and wherein the controlling unit controls the adjusting mechanism so that an amount of engagement of the first rotary member and the second rotary member in a case that the sheet is stopped at the cooling unit is smaller than an amount of engagement of the first rotary member and the second rotary member in a case that the sheet is not stopped at the cooling unit.

16. The image forming apparatus according to claim 15, wherein if the sheet is stopped at the cooling unit, the controlling unit controls the adjusting mechanism so that an amount of engagement of the first rotary member and the second rotary member is smaller as time of stop of the conveyance of the sheet becomes longer.

17. The image forming apparatus according to claim 14, wherein the first rotary member is a belt and the second rotary member is a shaft, wherein the cooling unit is configured to cool a side of the sheet having the image fixed thereon, wherein the shaft contacts the side of the sheet having the image fixed thereon and the belt contacts a side of the sheet opposite to the side of the sheet having the image fixed thereon, and wherein the controlling unit controls the adjusting mechanism so that an amount of engagement of the first rotary member and the second rotary member in a case that the sheet is stopped at the cooling unit is larger than an amount of engagement of the first rotary member and the second rotary member in a case that the sheet is not stopped at the cooling unit.

18. The image forming apparatus according to claim 17, wherein if the sheet is stopped at the cooling unit, the controlling unit controls the adjusting mechanism so that an amount of engagement of the first rotary member and the second rotary member is larger as time of stop of the conveyance of the sheet becomes longer.

* * * * *